US005178417A

United States Patent [19]

Eshoo

[11] Patent Number: 5,178,417

[45] Date of Patent: Jan. 12, 1993

[54] AUTOMATIC ORDERING METHOD AND APPARATUS

[76] Inventor: Fredrick Eshoo, 3676 Summit Ridge Ct., San Jose, Calif. 95148

[21] Appl. No.: 636,401

[22] Filed: Dec. 31, 1990

[51] Int. Cl.[5] ..... B12D 15/00

[52] U.S. Cl. ..... 283/67; 283/117; 283/81

[58] Field of Search ..... 283/67, 81, 117

[56] References Cited

FOREIGN PATENT DOCUMENTS 2210349 6/1989 United Kingdom ..... 283/81

OTHER PUBLICATIONS

FAX 96 Operators Manual p. 54 Release 2, May 31, 1990 Copyright 1990 Fremont Communications Co. FRECOM 46309 Warm Springs Blvd. Fremont, Calif., 94539 415-438 5001.

*Primary Examiner*—Paul A. Bell
*Attorney, Agent, or Firm*—Robert Samuel Smith

[57] ABSTRACT

A method and device for reordering items stored as groups in an inventory of items which includes an order sheet and a group of labels deposited with each group of items. Each label has a part number corresponding to the item and an index mark printed on one side and a second side treated with a peelable adhesive. When an item is withdrawn from a group of items, a label is attached to a sheet which thus becomes an order sheet. Index marks are printed on the order sheet which are aligned with index marks printed on each label. When the customer desires to order items to replenish depleted stock, he mails or "faxes" the order sheet to the supplier. The supplier may then (either manually or with character reading equipment) identify the item to be ordered and the quantity to be ordered from the number of labels on the order sheet. He may then compute price, taxes, etc., and print out an order form using this information. The index marks may simply be lines. The labels may be stored prior to use by peelable attachment to a sheet of labels or from a roll of labels.

6 Claims, 1 Drawing Sheet

AUTOMATIC ORDERING METHOD AND APPARATUS

FIELD OF THE INVENTION

This invention relates to a device and method for generating sales orders, particularly a method in which labels are attached to an order sheet for transmittal and computerized organization into an order form.

BACKGROUND OF THE INVENTION

A central part of most any business operation is the withdrawal of various items from inventory and reordering a new stock of the items as the original stock is depleted. For example, in the typical business office, a stock of items such as pencils, tablets, erasers, etc., is maintained for use by the office personnel. Usual procedure is for the office personnel or stock clerk to periodically check the bins or storage compartments containing the items and fill out an order sheet listing the various items, their item numbers and the quantity to be reordered.

There are a number of problems associated with this common rather haphazard practice. One problem is that reordering is costly because it generally requires trained personnel, is time consuming and is subject to error. Another problem is that some items in the inventory are depleted at a faster rate than other items so that an unexpected shortage can occur. Yet another problem is especially true of small businesses wherein the job of maintaining inventory is usually only one job of many that the stock clerk must do so that his/her performance is subject to errors and problems such as running out of stock that might be avoided by a more dedicated and simplified system. These inconveniences and additional expenses must be borne by the customer who is maintaining the inventory. U. K. Patent 2210349 A to Neame is for a method for keeping track of containers in which one portion of a two portion label is attached to the container and a second portion containing barcode is attached to delivery papers and sent to a central office where the bar code is machine read and stored in a computer as a record of the whereabouts of the container. The method does not involve machine recognition of alpha numeric characters that could be translated into ASCII representation and stored into computer memory. Nor does the Patent disclose any computational procedures that would be involved in any business operations other than simple registration as to the whereabouts of particular containers.

THE INVENTION

OBJECTS

It is an object of this invention to provide a method of ordering wherein the burden of compiling and computing information on an order form, including determining description of the items, quantity, price, depletion of inventory, ordering cycle, etc. is shifted from the customer to the supplier thereby saving time and cost for the customer.

It is another object to eliminate errors that would otherwise be made in recording description, computing price and quantity, etc., that result from inadequate familiarity or skill of the clerk or person with the reordering procedure.

It is another object to incorporate the use of certain well known devices such as the "FAX" machine or other delivery means, etc. to expedite and simplify the ordering procedure.

SUMMARY

The method and device of this invention includes the use of a paper "index" sheet and rolls of labels or "label" sheets, i.e., sheets with temporarily attached labels that may be peeled off when needed. A roll of labels or sheet of peelable labels is placed in each storage compartment. Each label is imprinted with alphanumeric characters representing the item number corresponding to the items in the respective storage compartment.

Every time an item is withdrawn from its storage compartment, a corresponding label is peeled from the sheet of labels and attached to an index sheet so that the index sheet will eventually have attached labels of all the various items that are to be ordered. The "index" sheet with all the labels attached thereby becomes an "order" sheet.

When a member of the office personnel wishes to replenish the inventory, he/she simply sends the order sheet to the supplier by FAX or mail.

The supplier analyzes the order sheet to identify the items and the quantity of each item to be ordered. The information is used to compute purchase data which includes description, quantity, cost, tax discounts, etc. An "order" FORM is compiled with this information with which the supplier may confirm the order to the customer.

DRAWINGS

DESCRIPTION OF THE PREFERRED EMBODIMENT

The following detailed description illustrates the invention by way of example and not by way of limitation of principles of the invention. This description will clearly enable one skilled in the art to make and use the invention and suggests several embodiments, adaptations, alternatives and uses of the invention including what I presently believe to be the best mode of carrying out the invention.

Figure 1:
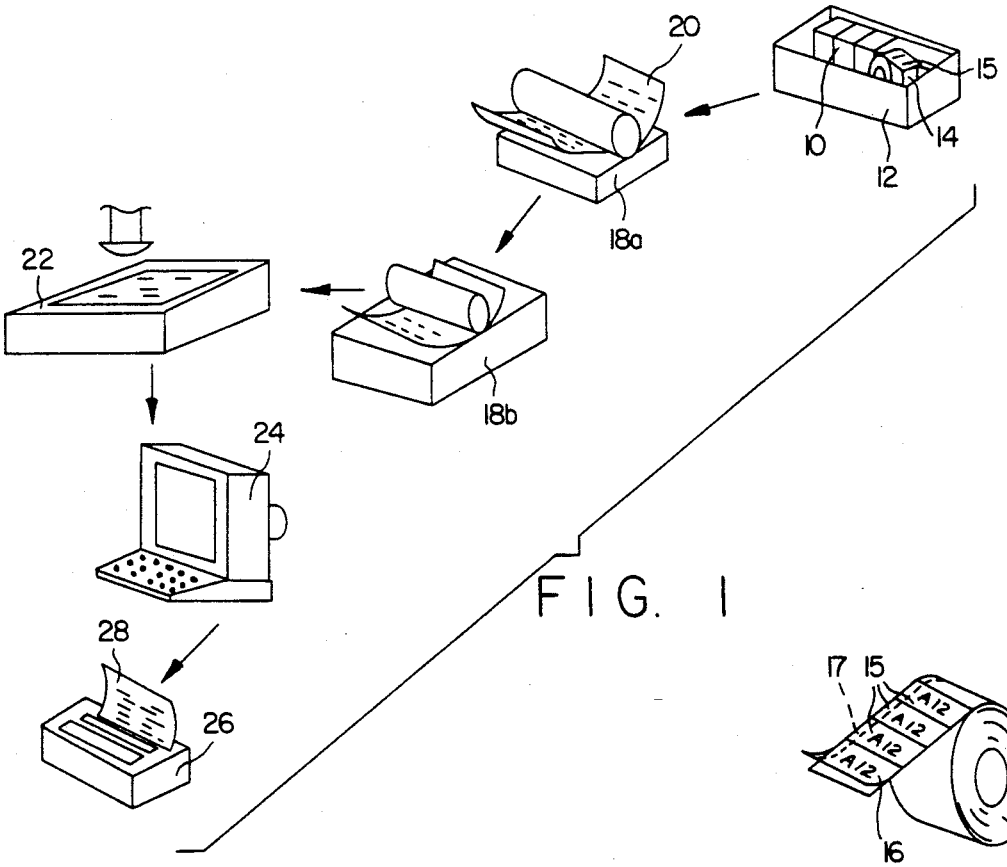
FIG. 1 shows the steps in the automatic ordering procedure.

Turning now to a discussion of the drawings, there is illustrated in FIG. 1 one embodiment of the method and apparatus of this invention. An inventory of items 10 has been placed in storage compartments 12 together with a roll of labels 14. Only one storage compartment is shown in FIG. 1 although it will be understood that the compartment is only one of many compartments.

Figure 2:
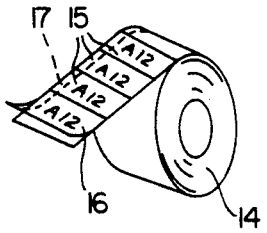
FIG. 2 shows a roll of labels showing alphanumeric characters printed thereon.

FIG. 2 shows the roll 14 of peelable labels 15. One label 16 is shown partially removed. Indicia (figures representing the item) is printed on each label. An index line 17 is also on each label.

Every time the user withdraws an item 10 from the storage compartment, he peels a label from the roll of labels and attaches the label 15 onto an "index" sheet 20. An "index" sheet with labels attached it forms an "order" sheet which is shown in FIG. 3.

Figure 3:
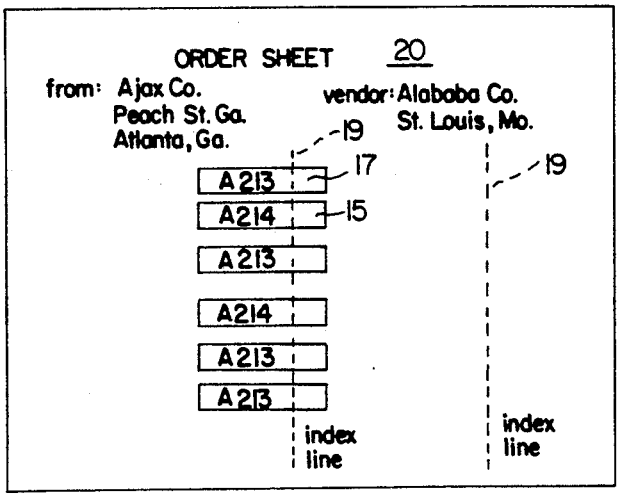
FIG. 3 shows labels with alphanumeric characters printed thereon attached to an "index" sheet which thereby becomes an "order" sheet.

FIG. 3 shows an order sheet with six labels attached indicating that six items have been taken from the storage compartment. Each sheet has vertical index lines 19

(two are shown.) Labels also have index lines 17 so the index line on each label is aligned with the vertical index line 19 on the index sheet, thereby providing that the attached label is in a position where it can be interpreted later by an automatic reader such as a bar code reader or other automatic scanning device capable of translating alphanumeric characters to the ASCII format such as a computing system as shown in FIG. 1 which includes any group 3 Facsimile machine 18*a*, an IBM PC Compatible Computer 38633, with an OCR Recognition Board TRU SCAN MODEL E from Calera Recognition Systems, A Gamma Fax CP Card from the GAmmalink Corp. 22 and 24, a Laser Jet 3 Printer 18*b*, and a Laser Jet 3 Printer 26.

As illustrated in FIG. 1, when the customer wishes to replenish his stock, he simply mails or "FAXES" (using fax machine 18*a*) his collection of order sheets to fax machine 18*b* of the supplier. When the order sheet arrives at the supplier, the information on the order sheet is read either manually or by character recognition equipment 22 in order to determine description and quantity of the items to be ordered. The equipment may be a bar code reader if the indicia on the label is in bar code.

The supplier is thereby informed as to which items and how many are being ordered by the indicia on attached labels. This information may then be entered automatically from the recognition equipment or manually into a computer 24 which determines purchase data including total price, tax, delivery date, etc. This data is compiled and printed out (by printer 26) on an "order" form 28. The supplier may use a copy of the order form to confirm the order with the customer.

In the foregoing paragraphs, a method of replenishing a stock of various items has been described which meets the objects of the invention. The method uses a number of labels attached to an index sheet whereby, the index sheet with attached labels becomes an order sheet. Index lines on the labels and index sheets provide for alignment of the labels when attached to the order sheet which permits interpretation by automatic character recognition devices such as object character readers or bar code readers. The combination label on order sheet device eliminates errors by the customer in transcribing item numbers and quantities to be ordered and minimizes the amount of effort that must be expended by the customer on the reordering process. The device of label on order sheet provides further convenience to the customer in terms of his ability to reduce paper work by simply "FAXING" or mailing the order sheet with labels attached to the supplier.

Convenience is provided to the supplier in terms of an order sheet that is amenable to automatic interpretation and computation of pertinent data.

It should be understood that various modifications within the scope of this invention can be made by one of ordinary skill in the art without departing from the spirit thereof. For example, in place of an index line on each label that is to be aligned with the index line on the order sheet, a mark on opposite edges of each label could be used for alignment with the index line on the sheet. The labels could be dispensed either from a roll as described above or from a label sheet. I therefore wish my invention to be defined by the scope of the appended claims and in view of the specification if need be.

I claim:

1. A system for producing an order form having purchase information for at least one item to be purchased, comprising:

an index sheet having a first surface carrying a first index mark;

a supply of item labels for at least one item to be purchased, each label carrying on a first surface alpha-numeric indicia corresponding to the item to be purchased, each said item label further carrying a second index mark for alignment with said first index mark on said index sheet;

adhesive means on a second surface of each of said item labels, whereby each label may be secured to said index sheet with said second index mark in alignment with said first index mark to form an order sheet carrying at least one label identifying said at least one item and representing a quantity of items to be purchased;

means for transmitting at least an image of said order sheet with secured labels to a remote location;

receiving means at said remote location for receiving said transmitted order sheet image and producing an output corresponding to said order sheet;

computer means responsive to said receiving means for determining from said order sheet image output item purchase data, including the quantity and identification of at least one item to be purchased; and means responsive to said computer for converting said purchase data to an order form having corresponding alpha-numeric purchase information.

2. The system of claim 1, wherein said transmitting means includes first facsimile means.

3. The system of claim 2, wherein said receiving means includes second facsimile means producing a copy of said order sheet image.

4. The system of claim 3, wherein said receiving means further includes reader means responsive to said copy of said order sheet image to produce said output.

5. A system for producing at a remote supplier location an order form carrying user purchase information for a plurality of items to be purchased by the user from the supplier, comprising a user index sheet having a first surface carrying a plurality of first index marks;

a plurality of groups of inventory items at the user location;

a supply of item labels for each of said groups, each supply of labels including at least one item label for each item in its corresponding group, each item label having a first surface carrying alphanumeric indicia printed at a first location, the indicia on each label corresponding to an item in the corresponding group;

a second index mark on said first surface of each of said item labels, said second index mark being printed at a second location on said first surface;

adhesive means on a second surface of each of said item labels to enable each label to be secured to said user index sheet with said second index mark in alignment with one of said first index marks to thereby provide on said user index sheet an indication of the identity and number of inventory items to be provided by a supplier;

means for transmitting to a remote supplier location an image of said user index sheet with secured labels;

receiver means at the remote supplier location for receiving a transmitted image of said user index sheet, the receiver means including means responsive to the transmitted image to determine from the labels secured to the user index sheet information concerning the identification and quantity of items to be supplied; and means for converting said information to alphanumeric form and for printing an order form carrying the alphanumeric information at said supplier location.

6. A system for producing an order form having alphanumeric purchase information concerning a quantity of at least one item to be purchased by a user who submits from a remote location an indication of said quantity and identification of said at least one item, which comprises:

an index sheet having an area with a first index mark;

a supply of item labels for each said at least one item, each label in each said supply having a first surface with alphanumeric indicia printed at a first location on said first surface, said alphanumeric indicia in each said supply corresponding to said respective item;

said first surface of each said item being imprinted at a second location on said first surface with a second index mark;

adhesive means on a second surface of each one of said item labels, providing that said quantity from each said supply of each label be secured to said index sheet with said second index mark of each label in alignment with said first index mark thereby submitting an indication to said apparatus on said index sheet said identification and quantity of said items to be purchased;

facsimile means for inputting from said remote location an image of said index sheet with secured labels to a computer means;

computer means in operable combination with said index sheet and labels and facsimile means for operating on said inputted image representing said quantity and identification of said at least one item to compute said purchase information when said first index marks are in said alignment with said second index mark;

means for converting said purchase information to alphanumeric form and printing an order form having said alphanumeric purchase information.

* * * * *